US009663971B2

(12) United States Patent
Yang

(10) Patent No.: US 9,663,971 B2
(45) Date of Patent: May 30, 2017

(54) COMBINATION LOCK

(71) Applicant: Yao-Kun Yang, Changhua County (TW)

(72) Inventor: Yao-Kun Yang, Changhua County (TW)

( * ) Notice: Subject to any disclaimer, the term of this patent is extended or adjusted under 35 U.S.C. 154(b) by 0 days.

(21) Appl. No.: 14/859,349

(22) Filed: Sep. 20, 2015

(65) Prior Publication Data

US 2017/0081881 A1 Mar. 23, 2017

(51) Int. Cl.
*E05B 37/02* (2006.01)

(52) U.S. Cl.
CPC ..... *E05B 37/02* (2013.01); *E05B 37/025* (2013.01)

(58) Field of Classification Search
CPC ..... E05B 37/02; E05B 37/025; E05B 67/00; E05B 67/02
See application file for complete search history.

(56) References Cited

U.S. PATENT DOCUMENTS 4,554,809 A * 11/1985 Yang ..... E05B 37/02 70/312
4,766,748 A * 8/1988 Yang ..... E05B 37/02 70/312
4,905,488 A * 3/1990 Hatsuo ..... E05B 37/02 70/308
4,970,881 A * 11/1990 Hsiao ..... E05B 37/025 70/25
5,007,262 A * 4/1991 Nakai ..... E05B 37/02 70/306
5,125,248 A * 6/1992 Ling ..... E05B 37/025 70/25
5,737,947 A * 4/1998 Ling ..... E05B 37/025 70/312
6,357,265 B1 * 3/2002 Chang ..... E05B 37/025 340/542
7,251,967 B2 * 8/2007 Yang ..... E05B 37/025 70/25
8,695,385 B2 * 4/2014 Meekma ..... E05B 37/02 292/254
2004/0226325 A1 * 11/2004 Ling ..... E05B 19/0005 70/63

* cited by examiner

*Primary Examiner* — Christopher Boswell
(74) *Attorney, Agent, or Firm* — Rosenberg, Klein & Lee

(57) ABSTRACT

A combination lock includes a casing, a number disk unit, a restriction member located above the number disk unit, and a resilient member cooperated with the number disk unit. The number disk unit has multiple rotary disks and multiple number disks, each number disk has multiple mark areas and multiple grooves located alternatively to the mark areas. The resilient member has multiple engaging portions which are resiliently engaged with the grooves of the number disks so as to ensure that each of the number disks is rotated one mark area and the engaging portion is engaged with the groove to pause the number disk. The combination lock is easily assembled and manufactured.

1 Claim, 7 Drawing Sheets

COMBINATION LOCK

BACKGROUND OF THE INVENTION

1. Fields of the Invention

The present invention relates to a combination lock, and more particularly, to a combination lock that is easily manufactured and the number disks are conveniently rotated.

2. Descriptions of Related Art

The conventional combination lock 1 is disclosed in FIG. 7 and comprises a casing 101 which has multiple partitions 102 defined therein. Each partition 102 has a number disk 103 received therein and each number disk 103 has multiple recesses 105 formed along an outer periphery of one end thereof. Each number disk 103 has multiple numbers formed thereon. Each partition 102 has a room 106 in which a spring 107 is received. A push member 108 is biased by the spring 107 corresponding thereto and each push member 108 has a protrusion which is engaged with one of the recesses 105 of the number disk 103 corresponding thereto. A plate 109 is mounted above the number disks 103, and a cover 100 is mounted to the casing 101 to accommodate all of the parts mentioned above in the casing 101. When rotating the number disks 103, the user has to overcome the force generated by the spring 107 biasing the push member 108. The push member 108 is therefore pressed downward by the user and the spring 107 is compressed. When the number disk 103 is rotated, the protrusion of the push member 108 is engaged with another recess 105 so that the number disk 103 can be rotated one number 104 each time, and the number disk 103 rotates a distance between the two adjacent recesses 105. This can ensure that the number disk 103 is rotated one number 104 to the adjacent number 104. However, the number of the springs 107 and the push members 108 are so tiny so that the assembling processes can be frustrated and take a lot of time. The manufacturing cost cannot be reduced.

The present invention intends to provide a combination lock to eliminate the shortcomings mentioned above.

SUMMARY OF THE INVENTION

The present invention relates to a combination lock and comprises a casing having a base and a cover mounted to the base. The cover has multiple first side holes and multiple openings, each opening communicates with one of the first side holes corresponding thereto. A number disk unit has a seat, a shaft, multiple number disks, multiple driving wheels and multiple rotary disks. The shaft is pivotably connected to the seat. Each driving wheel has a circular disk and a tubular portion extends from the circular disk. Each tubular portion extends through the number disk and the rotary disk corresponding thereto. The shaft extends through the number disks, the driving wheels and the rotary disks. Each number disk has multiple mark areas and grooves which are located alternatively to the mark areas. Each rotary disk has multiple protrusions extending radially from the periphery thereof. Each protrusion is located corresponding to one of the mark areas. At least one protrusion protrudes beyond the first side hole corresponding thereto.

A restriction member is located between the cover and the number disk unit. The restriction member has multiple second side holes which are located corresponding to the first side holes in the cover. The restriction member has multiple first recesses, multiple second recesses and multiple windows located corresponding to the number disks. A portion of each of the number disks is restricted by the first recesses. A portion of the periphery of the circular disk of each of the driving wheels is restricted by the second recesses. The windows are located corresponding to the mark areas and the openings.

A resilient member is located between the seat and the number disks. A flange extends perpendicularly from one side of the resilient member and is connected to one side of the seat. Multiple engaging portions extend from the other side of the resilient member and are respectively engaged with the grooves of the number disks. The number disks are biased by the engaging portions and restricted by the restriction member so that the number disks are rotated one mark area each time and are paused by the engaging portions.

The primary object of the present invention is to provide a combination lock, when the user rotates the number disks, each number disk is rotated one mark area and the number disk is paused by the engagement between the engaging portion of the resilient member and the groove of the number disk.

Another object of the present invention is to provide a combination lock which is easily assembled and manufactured.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
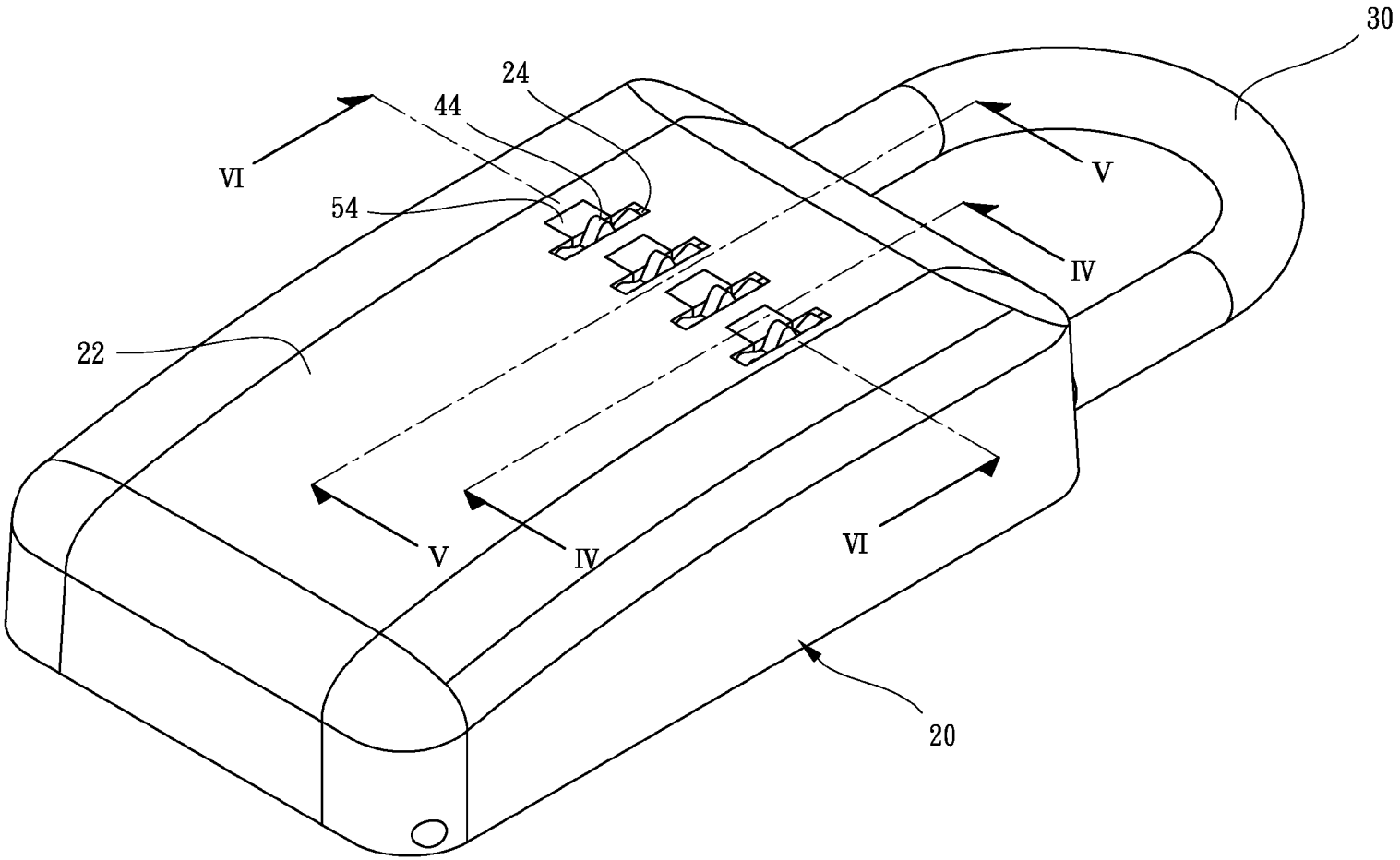
FIG. 1 is a perspective view to show the combination lock of the present invention.
Figure 2:
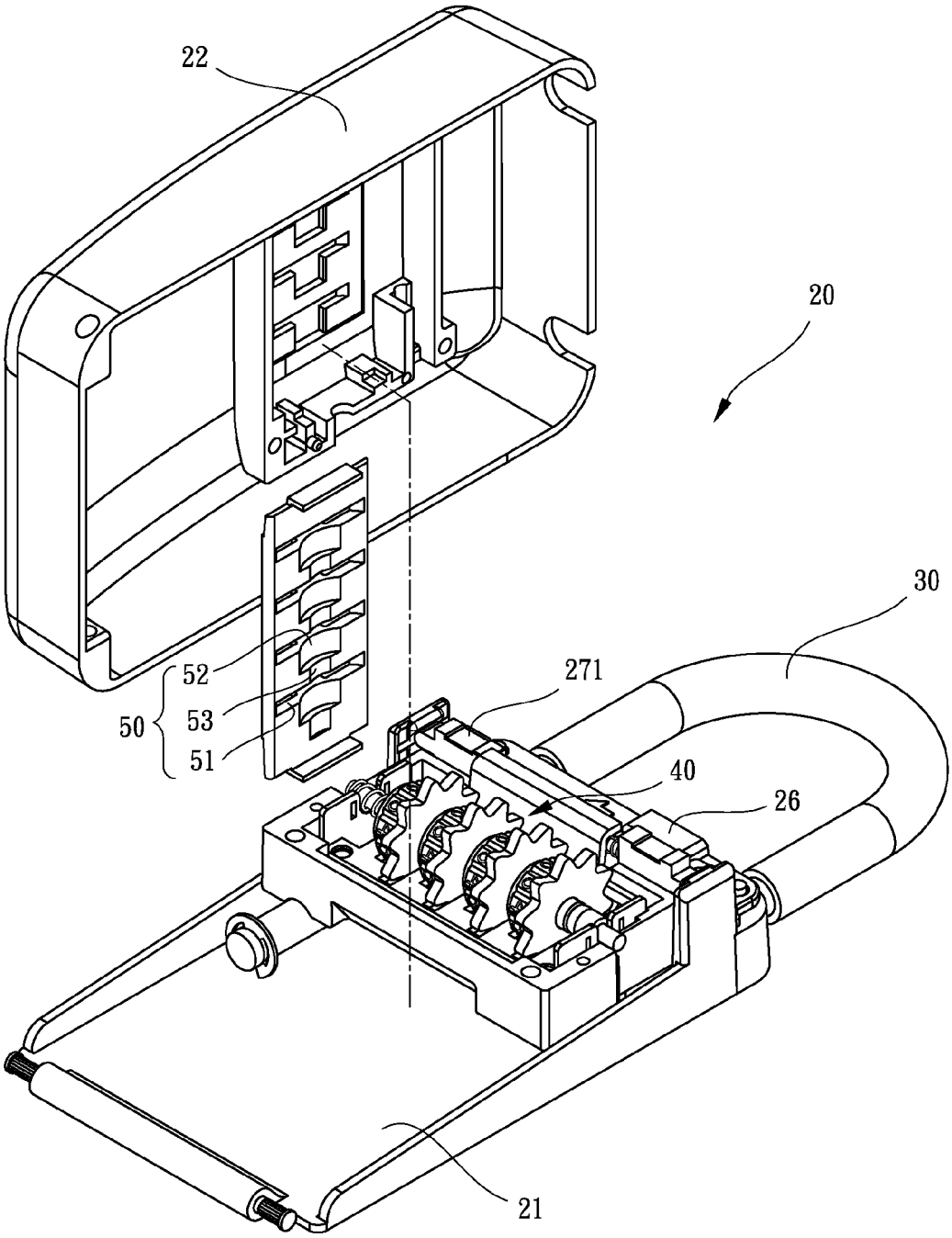
FIG. 2 shows that the cover of the combination lock of the present invention is separated from the base.
Figure 3:
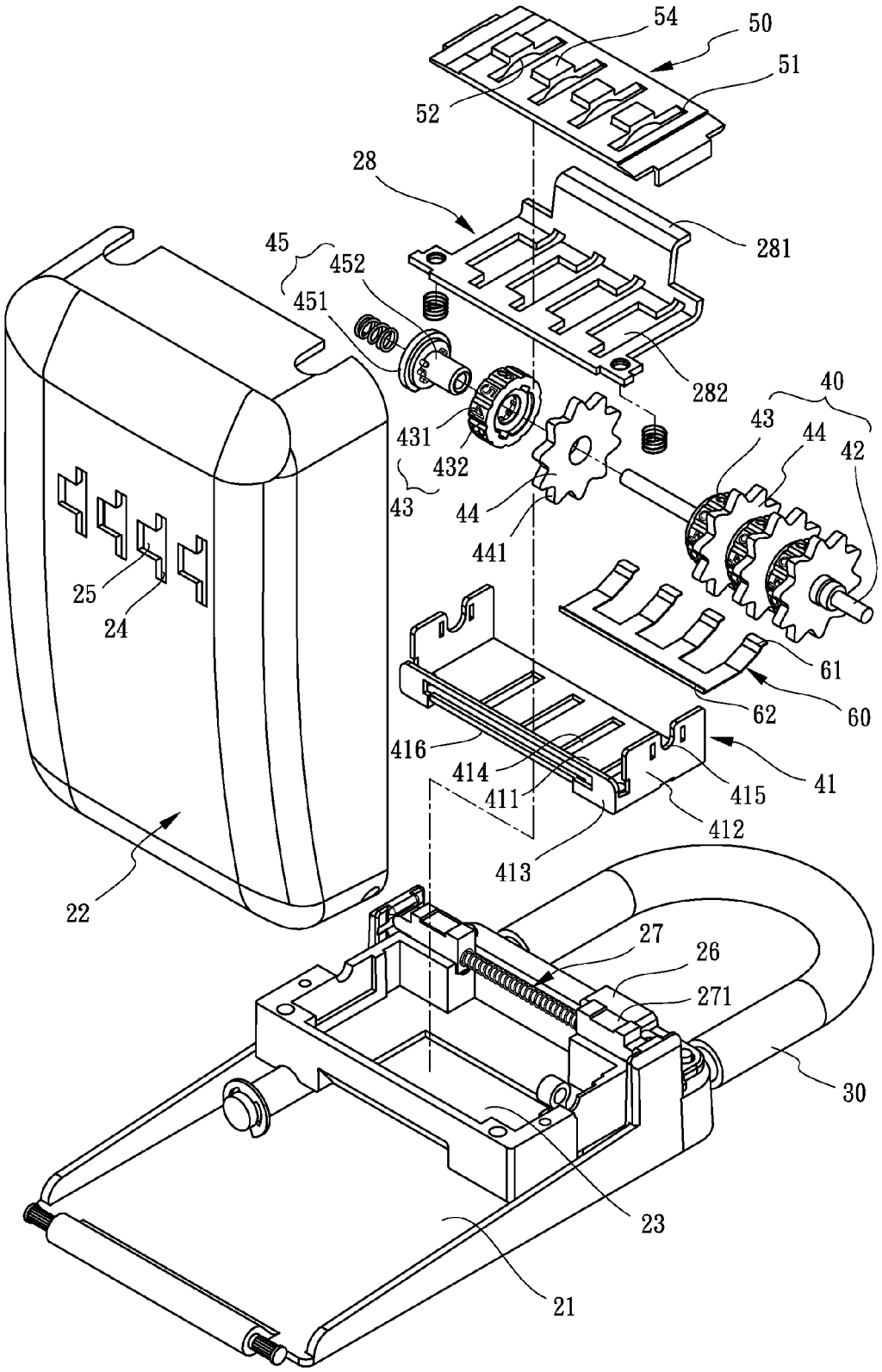
FIG. 3 is an exploded view to show the combination lock of the present invention.

Referring to FIGS. 1 to 3, the combination lock of the present invention comprises a casing 20 having a base 21 and a cover 22 which is mounted to the open side of the base 21. The base 21 has a space 23 defined therein, and the cover 22 has multiple first side holes 24 and multiple openings 25, each opening 25 communicates with one of the first side holes 24 corresponding thereto. A shackle 30 is connected to the casing 20, one end of the shackle 30 is connected to the casing 20, and the other end of the shackle 30 is removably inserted into the casing 20 so as to form the locked status and the opened status.

A number disk unit 40 has a seat 41, a shaft 42, multiple number disks 43, multiple driving wheels 45 and multiple rotary disks 44. The shaft 42 is pivotably connected to the seat 41. Each driving wheel 45 has a circular disk 451 and a tubular portion 452 which extends from the circular disk 451. Each tubular portion 452 extends through the number disk 43 and the rotary disk 44 corresponding thereto. The shaft 42 extends through the number disks 43, the driving wheels 45 and the rotary disks 44. Each number disk 43 has multiple mark areas 431 and grooves 432 which are located alternatively to the mark areas 431. The grooves 432 are defined transversely in the outer periphery of each of the number disks 43. The mark areas 431 provides 0 to 9 so as to allow the user to set the combination of the numbers. Each rotary disk 44 has multiple protrusions 441 extending radially from the periphery thereof. Each protrusion 441 is located corresponding to one of the mark areas 431. At least one protrusion 441 protrudes beyond the first side hole 24 corresponding thereto.

A restriction member 50 is located between the cover 22 and the number disk unit 40. The restriction member 50 has multiple second side holes 51 which are located corresponding to the first side holes 24 in the cover 22.

A resilient member 60 is located between the seat 41 and the number disks 43. A flange 62 extends perpendicularly from one side of the resilient member 60 and is connected to one side of the seat 41. Multiple engaging portions 61 extend from the other side of the resilient member 60 and respectively and resiliently engaged with the grooves 432 of the number disks 43. The number disks 43 are biased by the engaging portions 61 and restricted by the restriction member 50 so that the number disks 43 are rotated one mark area 431 each time and are paused by the engaging portions 61 engaging the next groove 432.

Figure 4:
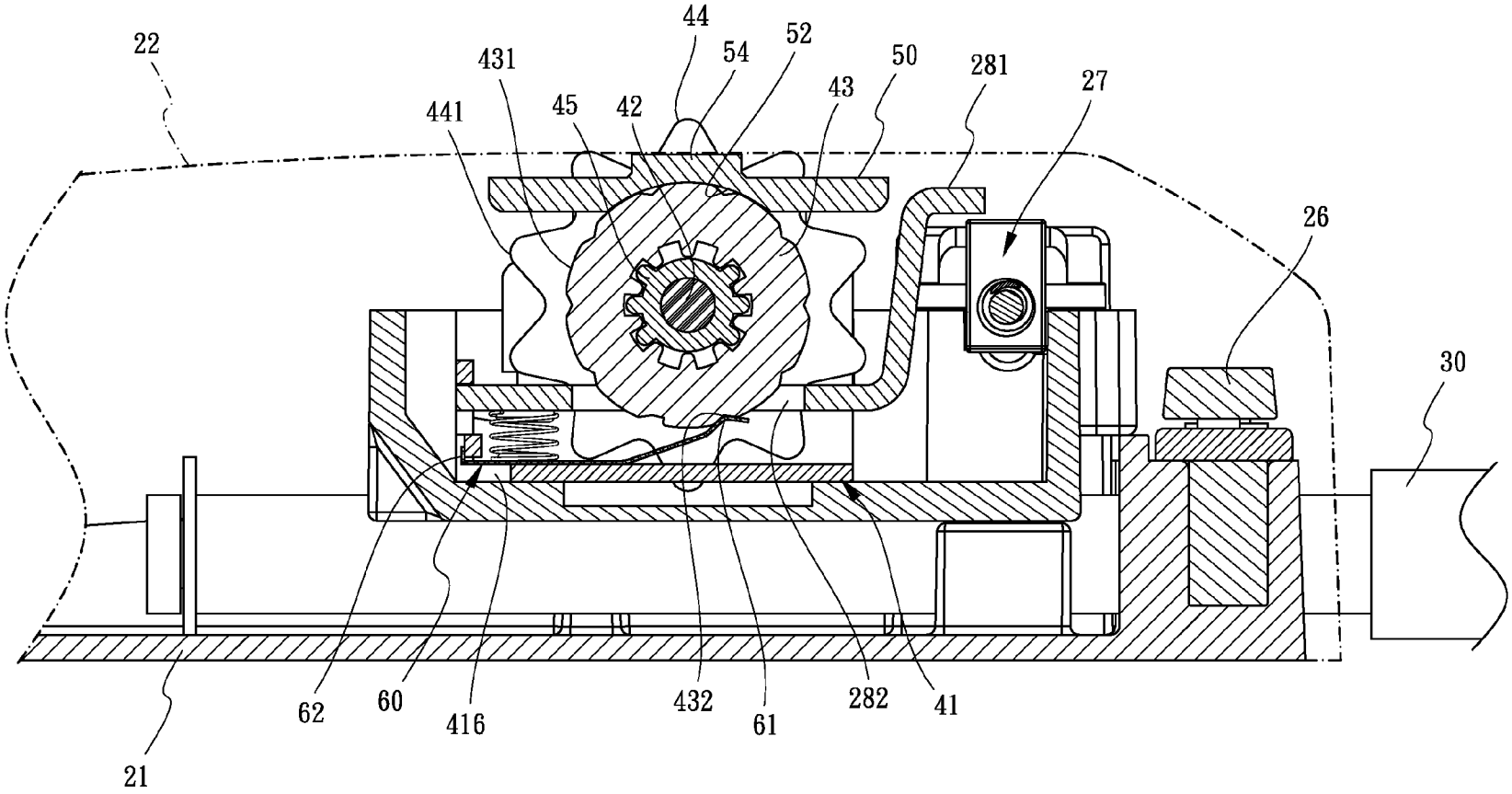
FIG. 4 is a cross sectional view, taken along IV-IV of FIG. 1.
Figure 5:
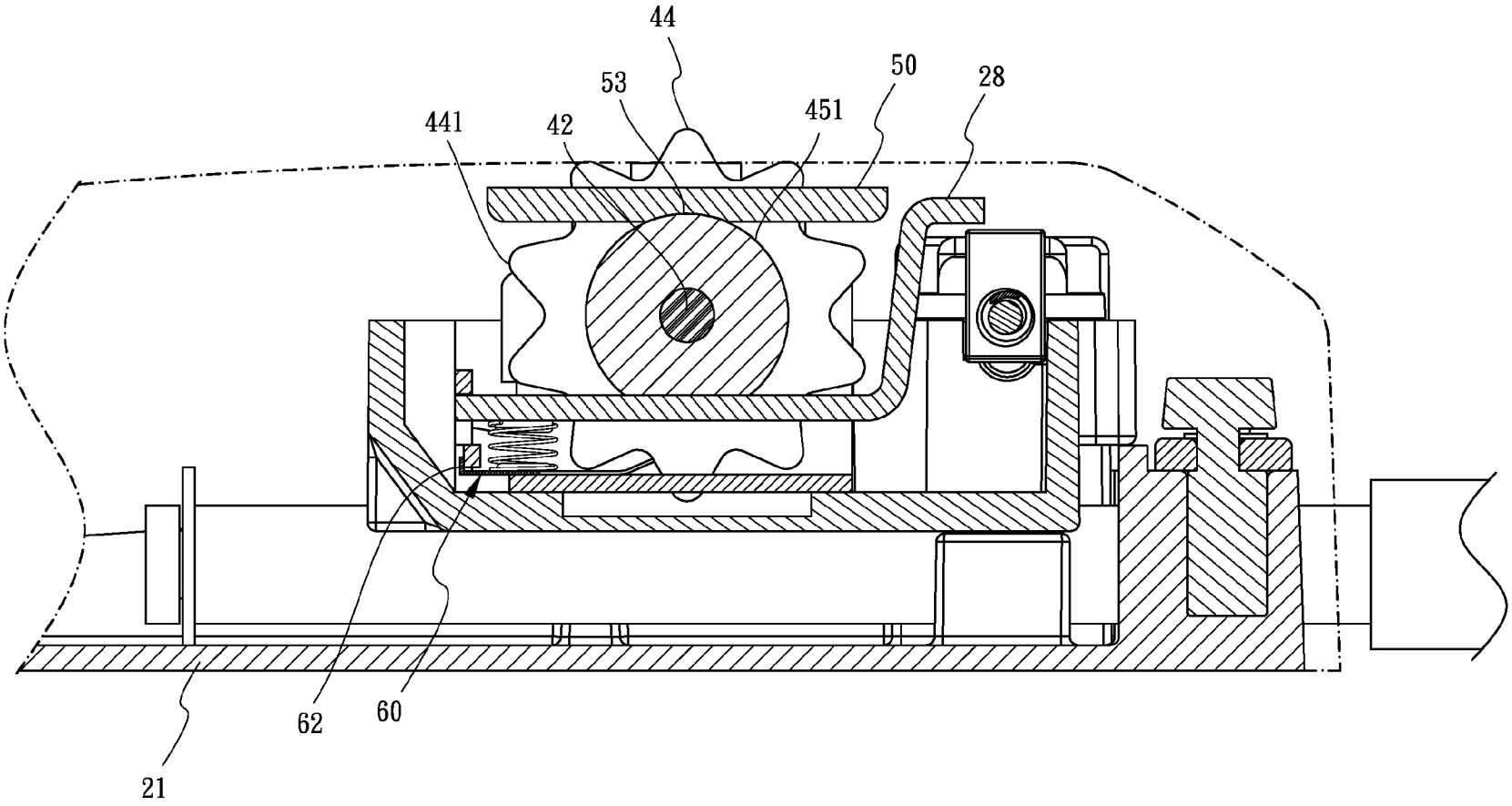
FIG. 5 is a cross sectional view, taken along V-V of FIG. 1.
Figure 6:
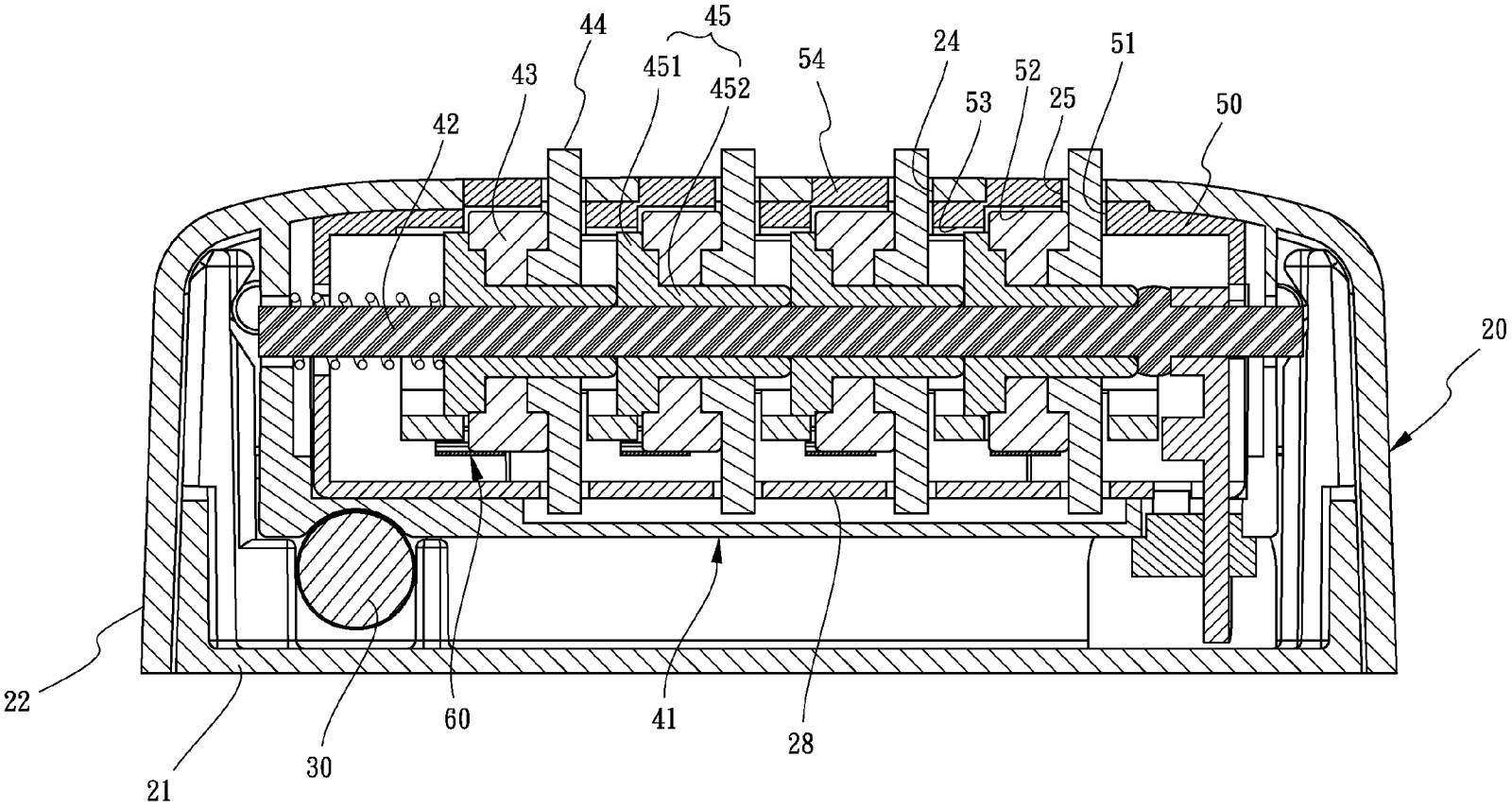
FIG. 6 is a cross sectional view, taken along VI-VI of FIG. 1.
Figure 7:
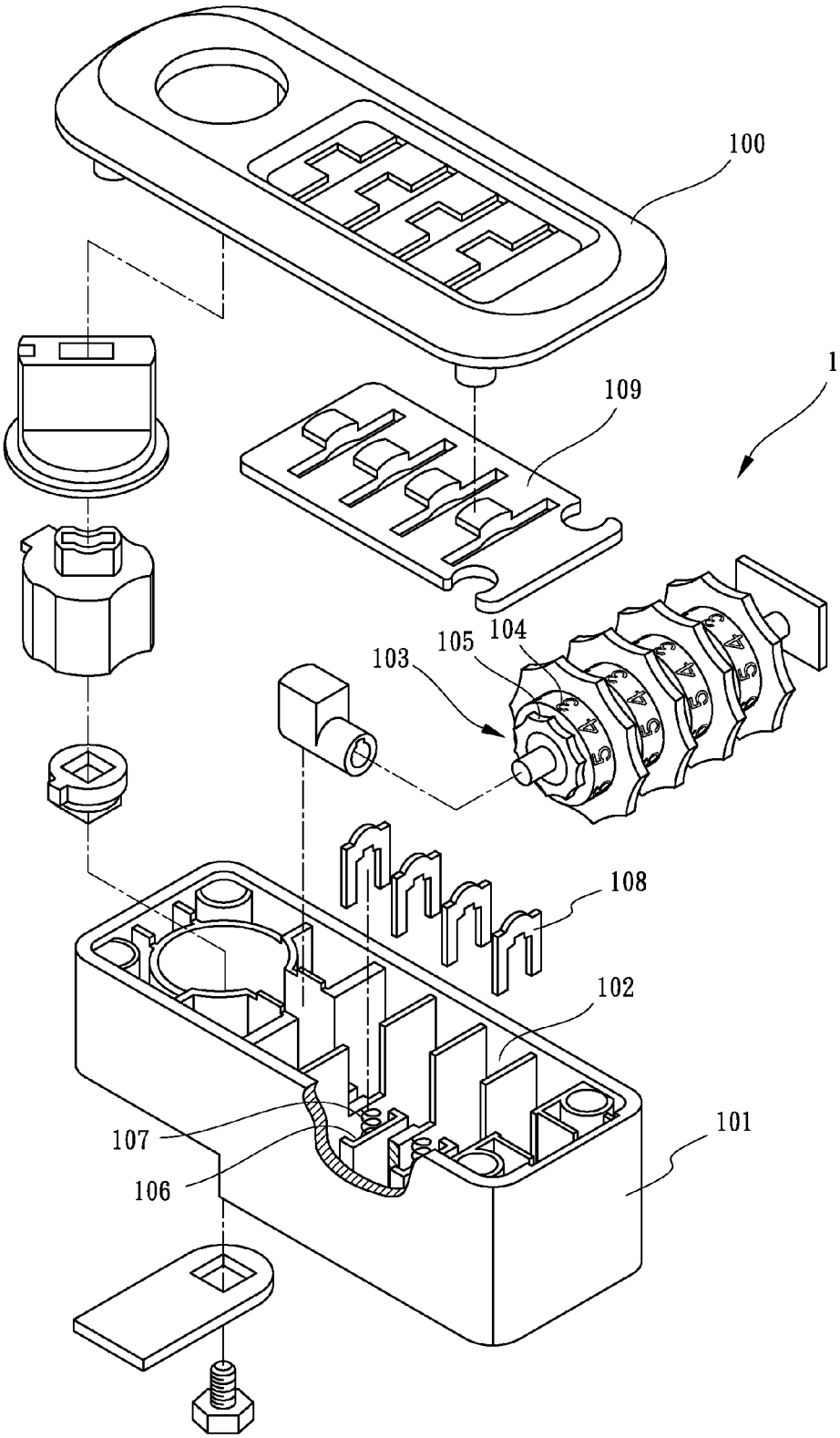
FIG. 7 an exploded view to show a conventional combination lock.

As shown in FIGS. 4 to 6, the restriction member 50 further has multiple first recesses 52, multiple second recesses 53 and multiple windows 54 located corresponding to the number disks 43. The windows 54 are located on the top of the restriction member 50, and the first recesses 52 are formed at the underside of the restriction member 50. Each of the windows 54 communicates with the second side hole 51 next to it. A portion of each of the number disks 43 is restricted by the first recesses 52, and a portion of the periphery of the circular disk 451 of each of the driving wheels 45 is restricted by the second recesses 53. The windows 54 located corresponding to the mark areas 431 and protrude from the openings 25 such that the numbers on the number disks 43 are enlarged. When the cover 22 is mounted to the base 21, the engaging portions 61 bias upward to the number disk unit 40. The restriction member 50 presses the number disk unit 40. The first recesses 52 restrict the number disks 43, the second recesses 53 restrict the driving wheels 45 so that the number disk unit 40 can be operated stably.

The seat 41 has a bottom plate 411, two walls 412 on two ends of the bottom plate 411, and a connection plate 413 which is connected between the two walls 412 and located on one side of the bottom plate 411. The bottom plate 411 has multiple elongated slots 414 which are parallel with the walls 412. Each wall 412 has a U-shaped notch 415 defined in the top edge thereof. The two ends of the shaft 42 are engaged with the two notches 415, and the at least one protrusion 441 of each of the rotary disks 44 protrudes from the elongated slots 414. An elongated hole 416 is defined through the connection plate 413. The flange 62 *f* of the resilient member 60 hooked to the elongated hole 416 as shown in FIG. 4.

The base 21 has a locking member 26 and a control member 27, wherein the control member 27 includes two blocks 271 which are able to be moved toward each other or away from each other. A movable member 28 is located between the number disk unit 40 and the seat 41. The movable member 28 has one end connected to the seat 41, and the other end of the movable member 28 has a stop 281 extending therefrom. The movable member 28 further has multiple slots 282 through which the number disks 43 and the rotary disks 44 extend. When the user rotates the rotary disks 44 to set the desired mark areas 431 to the pre-set positions, the stop 281 moves to a position above the two blocks 271, so that the cover 22 can be operand, such that the locking member 26 can be operated to release the shackle 30 to unlock the lock.

When the mark areas 43 are located at wrong positions, the stop 281 contacts between the two block 271 which protrude and contact the inside of the cover 22, so that the cover 22 cannot be opened. Therefore, the locking member 26 cannot be operated to release the shackle 30, the lock is still in the locked status.

The resilient member 60 uses the multiple engaging portions 61 to be resiliently engaged with the grooves 432 of the number disks 43 so as to ensure that each of the number disks 43 is rotated one mark area 432 each time and the engaging portion 61 is engaged with the groove to pause the number disk 43. The number disks 43 cannot be rotated to pass multiple mark areas 432 each time regardless of the direction that the number disks 43 are rotated. The resilient member 60 is easily manufactured and assembled so that the assembling time is shortened.

While we have shown and described the embodiment in accordance with the present invention, it should be clear to those skilled in the art that further embodiments may be made without departing from the scope of the present invention.

What is claimed is:

1. A combination lock comprising:

a casing having a base and a cover which is mounted to an open side of the base, the base having a space defined therein, the cover having multiple first side holes and multiple openings, each opening communicating with one of the first side holes corresponding thereto;

a number disk unit having a seat, a shaft, multiple number disks, multiple driving wheels and multiple rotary disks, the shaft pivotably connected to the seat, each driving wheel having a circular disk and a tubular portion extending from the circular disk, each tubular portion extending through the number disk and the rotary disk corresponding thereto, the shaft extending through the number disks, the driving wheels and the rotary disks, each number disk having multiple mark areas and grooves which are located alternatively to the mark areas, each rotary disk having multiple protrusions extending radially from a periphery thereof, each protrusion being located corresponding to one of the mark areas, at least one protrusion protruding beyond the first side hole corresponding thereto;

a restriction member located between the cover and the number disk unit, the restriction member having multiple second side holes which are located corresponding to the first side holes in the cover, the restriction member having multiple first recesses, multiple second recesses and multiple windows located corresponding to the number disks, a portion of each of the number disks being restricted by the first recesses, a portion of a periphery of the circular disk of each of the driving wheels being restricted by the second recesses, the windows located corresponding to the mark areas and the openings, and a resilient member located between the seat and the number disks, a flange extending perpendicularly from one side of the resilient member and connected to one side of the seat, multiple engaging portions extending from the other side of the resilient member and respectively engaged with the grooves of the number disks, the number disks being biased by the engaging portions and restricted by the restriction member so that the number disks are rotated one mark area each time and are paused by the engaging portions.

* * * * *